United States Patent [19]

Daniels

[11] 4,398,639

[45] Aug. 16, 1983

[54] SAFETY TOWEL BAR FOR WALL PANELS

[75] Inventor: Phillip D. Daniels, Bloomfield, Mich.

[73] Assignee: Novi Plastics Company, Novi, Mich.

[21] Appl. No.: 294,910

[22] Filed: Aug. 21, 1981

[51] Int. Cl.[3] ..... A47K 10/00

[52] U.S. Cl. ..... 211/105.1; 4/576; 4/605; 211/123; 248/251; 312/242; 312/245

[58] Field of Search ..... 211/105.1, 16, 87, 123; 248/201, 251; 4/576, 577, 559, 605, 661; 312/242, 245; D6/99, 103; 52/27, 36, 39

[56] References Cited

U.S. PATENT DOCUMENTS

| | | | |
|---|---|---|---|
| D. 187,456 | 3/1960 | Bonistall | D6/99 X |
| 3,028,604 | 4/1962 | Warner | 4/576 |
| 3,977,136 | 8/1976 | Daniels | 52/35 |
| 3,996,703 | 12/1976 | Daniels | 52/35 |
| 4,020,602 | 5/1977 | Daniels | 52/35 |
| 4,228,552 | 10/1980 | Weaver | 52/35 |
| 4,361,368 | 11/1982 | Daniels | 312/245 |

*Primary Examiner*—James T. McCall
*Assistant Examiner*—David L. Talbott
*Attorney, Agent, or Firm*—Cullen, Sloman, Cantor, Grauer, Scott & Rutherford

[57] ABSTRACT

A safety towel bar for a plastic wall surround panel for showers and tubs comprises a substantially flat plastic wall panel adhesively secured to a dry wall which is secured to a framework. A pair of laterally spaced rearwardly opening upright channels are integral with the panel and receive the ends of a towel bar, which are nested, supported and secured upon a pair of laterally spaced brackets secured to the dry wall and extend into the channels.

11 Claims, 7 Drawing Figures

FIG. 1
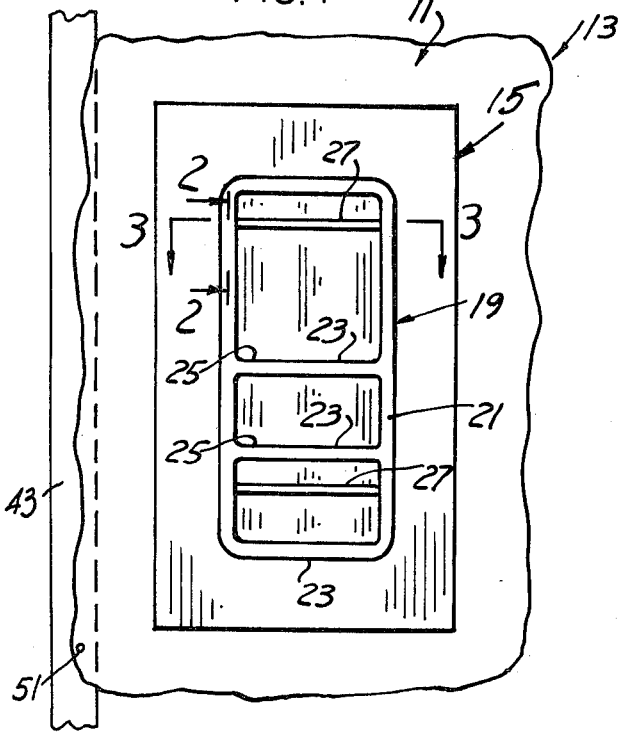
FIG. 2
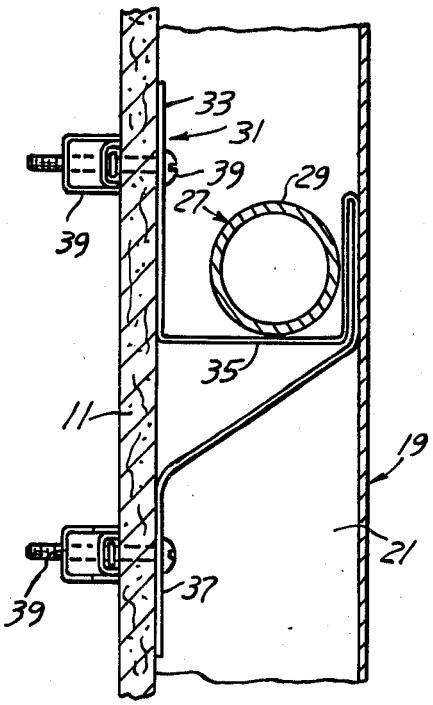
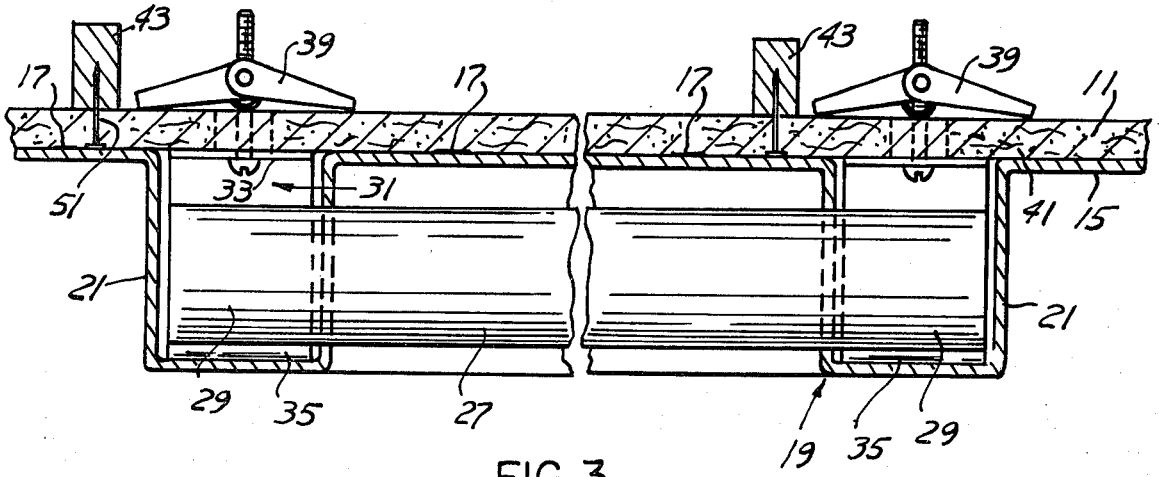
FIG. 3

SAFETY TOWEL BAR FOR WALL PANELS

BACKGROUND OF THE INVENTION

Heretofore in connection with a towel bar mounted upon a plastic wall panel as a part of a wall surround for showers and tubs, there has been applied thereto towel bars adapted for supporting a nominal load. In an emergency situation, a user may use the towel bar as a safety bar to avoid slipping or falling within the possibility that the outward and downward thrust upon the towel bar could separate the wall panel which is adhesively secured to a conventional backing such as a dry wall or other surface.

In the use of such plastic wall panels, adhesive is used in very limited quantities for securing the panel to the backing because if too much adhesive is used, there is a danger of migration of some of the adhesive into and through the plastic panel damaging its appearance. Therefore, the panel is anchored only by adhesive so that an accidental pulling upon the towel bar when used as a safety bar will have a tendency of pulling the panel from the backing as a source of danger to the user.

Such use of the towel bar as a safety bar may result in an accidental fall might be considered a breach of an implied warranty of structural strength, though the primary function was used as a towel bar only.

THE PRIOR ART

In the prior art, such as shown in Applicant's United States patents:

| | | |
|---|---|---|
| 3,977,136 | August 31, 1976 | Phillip D. Daniels |
| 3,996,703 | December 14, 1976 | Phillip D. Daniels |
| 4,020,602 | May 7, 1977 | Phillip D. Daniels |

there are shown examples of wall surround panels used for stall showers and tubs.

Each of these panels is constructed of a thin acrylic plastic and are secured in position by a limited amount of adhesive. Designing these panels so as to support towel bars, some means must be provided for anchoring the towel ends not to the panel, but to the backing dry wall or other surface or building framework.

In U.S. Pat. No. 4,228,552 dated Oct. 21, 1980, Charles S. Weaver, Jr., there is disclosed for a bathtub wall surround a vertical grab bar arranged forwardly of the wall panel directly fastened to the upright "2" by "4" studs of the building framework. In this case, the anchoring of the grab bars is by the use of fasteners which project through the grab bar end directly into the studs. In more situations than not, conventional spacing and location of building studs in unpredictable and normally do not match the spacing and location of the grab bars or towels so that some other means is required for anchoring the safety bar or grab bar in the one situation, and the towel bar in the other situation.

SUMMARY OF THE INVENTION

It is the object of the present invention to provide a safety towel bar for use in conjunction with a plastic wall surround panel for showers and tubs and wherein to the dry wall conventionally secured to the building framework there is adhesively connected the present wall panel. Said panel includes a pair of laterally spaced outwardly projecting channels integral therewith. The channels open rearwardly of the panel and receive the ends of an elongated horizontal tube whose ends project into said channels and are supportably mounted and secured and retained upon a pair of brackets which are spaced upon the dry wall and secured thereto and which project into the said channels.

It is a further object to provide a safety mounting for a towel bar supported upon a wall panel wherein the end portions of the towel bar tube exposed to the rear wall of the panel are supportably mounted and secured by a pair of brackets which are properly spaced and affixed to the dry wall in such a manner that upon application of the panels to the dry wall, the end portions of the towel bar will be received by and supported upon the said brackets. This provides a positive anchor for the towel bar independent of the wall panel.

It is a further object to provide a safety towel bar which is arranged forwardly of a wall panel such as used in a surround for showers and tubs and wherein the towel bar, if accidentally used as a safety bar or grab bar is independently anchored to the dry wall and to the frame work wherein such anchoring absorbs any outward or downward thrust applied to the towel bar.

It is another object to provide a safety towel bar assembly which does not require the anchoring of brackets upon conventionally spaced upright studs of the building framework, but wherein the brackets are effectively anchored to the dry wall which spans such studs and structurally support the towel bar ends against any outward or downward forces.

It is a further object to provide a safety towel bar for such wall panel wherein the mounting and anchoring of the towel bar does not depend upon the adhesive mounting of the panel to the dry wall, but on the other hand there is provided an independent structural support for the towel bar ends independent of the panel.

While the U.S. Pat. No. 4,228,552 may disclose the use of positive fastening of vertical grab bars upon a surround paneling, here the fasteners employed extend from the outside directly through the bars, through the spacers and through the paneling and into the 2 by 4 studs themselves for a positive anchor.

One important feature of the present invention is to direct the mounting of the towel bar such that no fasteners are shown to mar the appearance of the paneling. On the other hand, the hidden ends of the towel bar or tube are separately and independently supported and mounted upon a pair of laterally spaced brackets secured to the dry wall, and not to the studs, and which project into channel portions of the panelling to supportably receive and secure end portions of the towel bar.

These and other objects will be seen from the following specification and claims in conjunction with the appended drawings.

THE DRAWINGS

FIG. 1 is a front elevational showing the present safety towel bar for a wall panel surround for use in conjunction with showers and tubs adhered to a dry wall secured upon a building framework fragmentarily shown.

FIG. 2 is a vertical section taken in the direction of arrows 2—2 of FIG. 1, on an increased scale.

FIG. 3 is a fragmentary plan section taken in the direction of arrows 3—3 of FIG. 1, on an increased scale.

Figure 5:
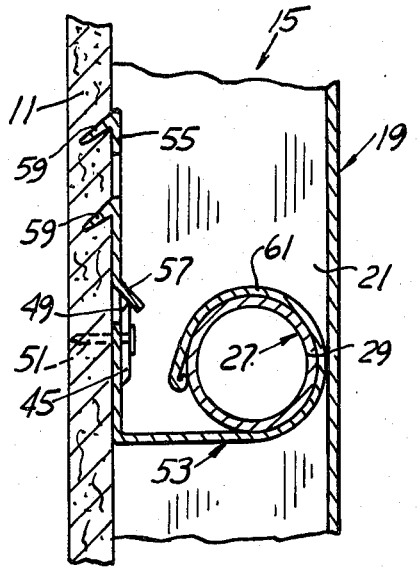
FIG. 5 is a vertical section taken in the direction of arrows 5—5 of FIG. 4.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

The present safety towel bar is adapted for use in conjunction with the conventional plastic wall surround panels such as are used for showers and tubs of the type disclosed in the aforementioned United States patents of applicant.

Conventional dry wall 11 supplied by United States Gypsum Company and others is arranged in an upright position and secured to the building framework 43 as by a plurality of nails or other fastener 51, FIG. 3. The present wall panels are particularly used in conjunction with an enclosed shower or tub area generally indicated at 13, FIG. 1, with the dry wall 11 fragmentarily shown spanning adjacent portions of the framework "2×4" as in FIGS. 1 and 3.

The present plastic wall panel is the same as is disclosed in Applicant's above mentioned earlier issued United States patents and is normally of a extruded acrylic plastic material often referred to as A.B.S. The panel 15 in a conventional manner is secured to dry wall 11 by the adhesive 17, FIG. 3 which is applied in limited quantities to the back surface of the panel. This securing is disclosed in the aforementioned patents. Formed as an integral part of the panel is a shelf and towel storage projection 19 which extends forwardly of the front face of the panel 15 and includes a pair of laterally spaced upright channels 21 as an integral part thereof. Said channels open rearwardly adjacent the dry wall 11, FIGS. 2 and 3.

The shelf and towel storage projection 19 is of a continuous form in the present embodiment, or it could be limited to a pair of forwardly facing rearwardly opening laterally spaced channels. These are apertured at their opposing innerfaces to receive the ends 29 of the elongated tube or towel bar 27, FIG. 3.

In the illustrative embodiment, the present shelf and towel storage projection 19 includes a pair of laterally spaced upright channels 21, connecting and communicating channels 23 which interconnect the tops and bottoms of the upright channels and extend intermediate the ends of channel 21 to define one or more shelves 25.

A pair of laterally spaced towel support brackets 31, FIGS. 2 and 3, have a spacing corresponding to the spacing of channels 11, are applied to and secured to the dry wall 11 as by suitable fasteners, such as by the butterfly fasteners 39. These fasteners include threaded bolts which extend through apertures in the back plate 33 of brackets 31, through apertures 41 in the dry wall and threadedly mount the toggle fasterners 39. Tightening of the bolt portions 39 operatively and retainingly engage the rear surface of the dry wall for fixedly securing brackets 31 thereto.

Figure 4:
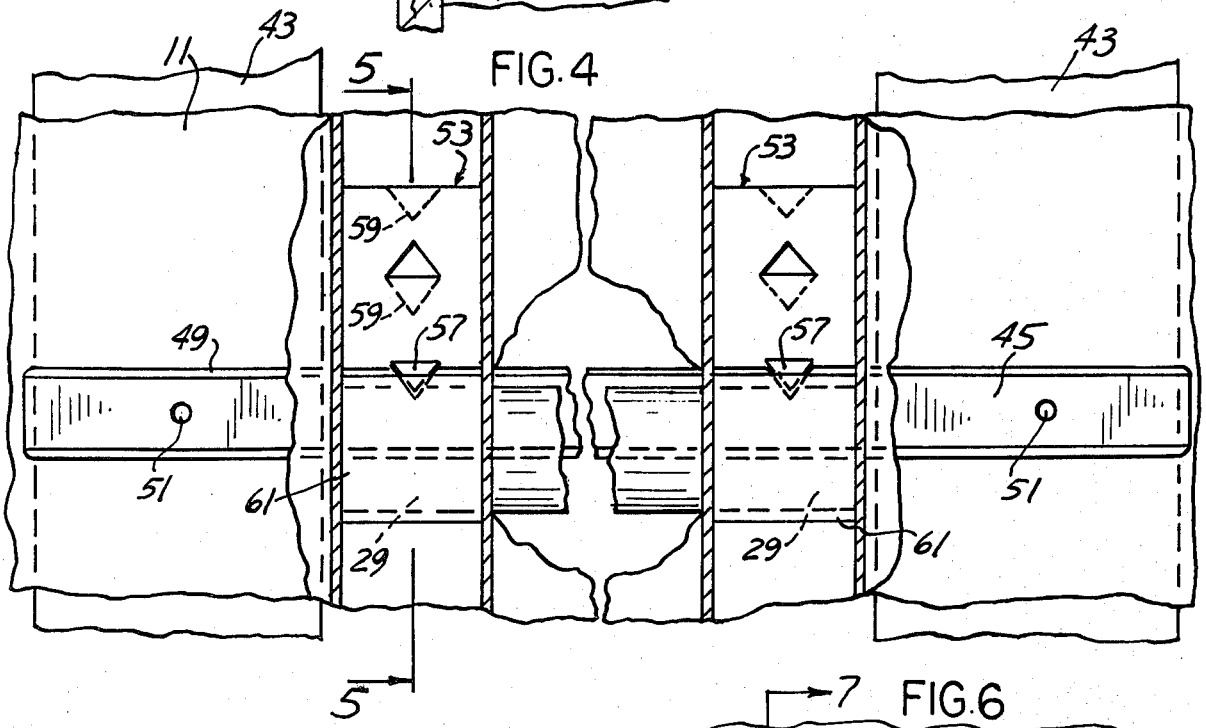
FIG. 4 is a fragmentary elevational section of a modified bracket mounting for the towel bar.

While the dry wall 11 is secured to the building framework studs 43 by fasteners 51, FIGS. 3 and 4, the towel bar ends 29 are supportably nested and secured and mounted within and upon U-support 35 connected to the back plate 33 of the respective brackets 31, FIGS. 2 and 3.

Bracket 31 includes anchor plate 37 which at one end bears against dry wall 11 and is secured thereto by an additional toggle fastener 39. Anchor plate 37 includes a portion which is inclined outwardly and upwardly and at its upper end is connected to the U-support 35 at its upper outer edge as a continuation thereof. The construction of the supporting brackets 31, FIGS. 2 and 3 provides a means by which the respective brackets are positively anchored to the dry wall providing a firm structural support for the ends 29 of towel bar 27.

Aftr the panel 15 has applied thereto continuous areas of a suitable adhesive 17, such as further disclosed in the earlier mentioned patents of the Applicant, the panel is lowered into position upon the dry wall with the brackets 31 so spaced that when the panel as been properly positioned against wall 11 simultaneously the ends 29 of the towel bar 27 are supportably nested within the brackets 31 which extend into the respective channels 21.

Figure 6:
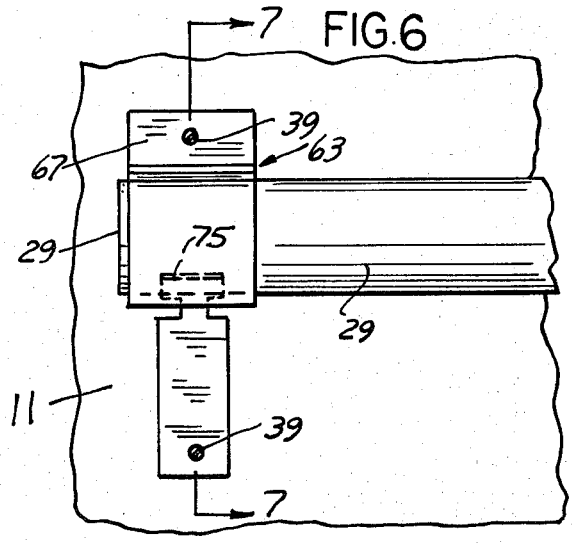
FIG. 6 is a fragmentary elevational view of a modification of the towel bar end bracket mounting shown in FIG. 2.

A modified form of bracket is shown in FIGS. 5 and 6 wherein spanning a pair of adjacent 2 by 4 studs 43, forming a part of the building framework, is an elongated horizontal metal strip 45 secured to said studs by the mails 51. The top edge of the strip is tapered at 49, FIG. 5.

A pair of upright laterally spaced modified towel bar support brackets 53 of L-shape are mounted upon dry wall 11 and project forwardly thereof. Each bracket includes upright back plate 55. Support prong 57 is struck out from said back plate and extends downwardly and forwardly, FIG. 5, and bears against and is supported upon strip 45, FIG. 4. The angular undersurface of the prong 57 is in cooperative registry with the taper edge 49 of strip 45. A pair of longitudinally spaced anchor prongs 59 are further struck out from back plate 55 rearwardly thereof and are inclined downwardly and outwardly adapted for embedded securing engagement with the dry wall 11.

Bracket 53 includes at the lower end of back plate 55 an L-shaped formation which terminates in the resilient loop 61 adapted to supportably receive the corresponding ends 29 of the transverse horizontal tube 27 forming the present towel bar.

One form of assembly of the panel 15 in FIG. 5 relative to the dry wall is to first assemble the loops 61 to surround the ends 29 of the tube 27 and thereafter to manually position the panel so that anchor prongs 59 pierce and project downwardly into dry wall 11. At the same time support prong 57 overlies and retainingly engages strip 45.

Figure 7:
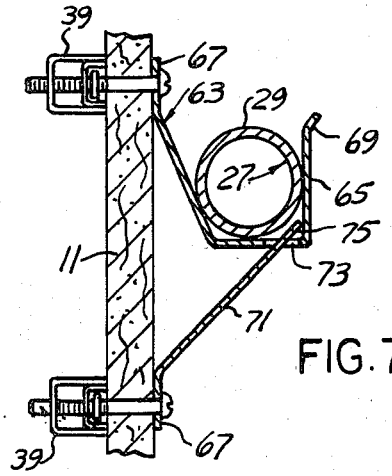
FIG. 7 is a fragmentary section taken in the direction or arrows 7—7 of FIG. 6.

A modified towel support bracket is shown at 63, FIGS. 6 and 7, which corresponds substantially to bracket 31 of FIG. 2. Here the pair of laterally spaced towel bar support brackets 63 each include a mount flange 67 which bears against dry wall 11 and is secured thereto by a toggle fastener 39. Said mount flange terminates in a U-shaped support 65 having an outturned assembly lip 69.

The pair of laterally spaced brackets 63 are suitably secured to the dry wall 11 and so spaced as to project into the rearwardly opening upright channels 21, FIG. 2 and are adapted to supportably receive the ends 29 of the towel bar 27. Bracket 63 includes a reinforcing anchor plate 71 which at one end has a mount flange 67 which is suitably secured to dry wall 11 as by an additional fastener 39, FIG. 7. The other end of plate 71 has a T-anchor formation 75 which projects through a transverse slot 73 within the base of U-shape support 65.

In this construction, the same is in the towel bar assembly described with respect to FIGS. 1, 2 and 3, as the panel 15 with the assembled towel bar 27 thereon is positioned against wall 11 the corresponding forwardly extending brackets 63 project into the corresponding panel channels 21 which supportably receive and engage the ends 29 of tube 27.

Having described my invention, reference should now be had to the following claims:

I claim:

1. A safety towel bar for a plastic wall surround panel for showers and tubs comprising a building framework having a dry wall secured thereto;

a pair of laterally spaced support brackets secured to and projecting forwardly of said dry wall;

a substantially flat plastic wall panel overlying and adhesively secured to said dry wall;

said panel having a pair of laterally spaced outwardly projecting upright channels integral therewith;

said channels opening rearwardly of said panels;

an elongated horizontal tube forwardly of said panel with its ends projected into said channels;

said tube ends within said channels being supportably positioned over, mounted upon and retained by said brackets against outward and downward movement.

2. The safety towel bar of claim 1, said brackets opening upwardly, said tube ends nested within said brackets during assembly and securing of said panel to said dry wall.

3. In the safety towel bar of claim 1, said channels having a predetermined spacing;

said brackets having the same spacing and being projected into said channels.

4. In the safety towel bar of claim 1, the securing of said brackets including fasteners engaging said brackets, projecting through and retainingly engaging the back of said dry wall.

5. In the safety towel bar of claim 1, each bracket having an upright back plate bearing against and secured to said dry wall and terminating in a forwardly positioned U-shaped tube receiving cradle;

and an upright anchor plate at one end bearing against and secured to said dry wall and at its other end connected to said cradle.

6. In the safety towel bar of claim 5, said anchor plate being integral with and forming an extension of said cradle.

7. In the safety towel bar of claim 5, the connection of said anchor plate to said cradle including a cooperating T-projection and slot formed in said anchor plate and cradle respectively.

8. In the safety towel bar of claim 1, each bracket having an upright back plate of L-shape bearing against and securing to said dry wall and terminating in a flexible loop receiving an end of said tube.

9. In the safety towel bar of claim 1, the securing of said brackets to said dry wall including a horizontal strip upon said dry wall spanning portions of said framework and secured thereto;

each bracket having an upright back plate;

a support prong struck out from said back plate inclined outwardly and downwardly supported upon said strip;

and a pair of spaced prongs struck out from said back plate extending inwardly and downwardly and retainingly projected into said drywall.

10. In the safety towel bar of claim 9, said back plate being of L-shape and terminating in a yieldable loop receiving an end of said tube.

11. In the safety towel bar of claim 1, said upright channels forming a part of a continuous channel having upright sides, a top and bottom and at least one transverse shelf defining cross channel extending between said upright channel.

* * * * *